US006497461B1

(12) United States Patent
Harlan

(10) Patent No.: US 6,497,461 B1
(45) Date of Patent: Dec. 24, 2002

(54) DISPLAY CASE

(76) Inventor: Campbell Harlan, 134 Woodhaven Way, Alpharetta, GA (US) 30004

( * ) Notice: Subject to any disclaimer, the term of this patent is extended or adjusted under 35 U.S.C. 154(b) by 3 days.

(21) Appl. No.: 09/628,489

(22) Filed: Jul. 31, 2000

(51) Int. Cl.[7] ..... A47F 3/06
(52) U.S. Cl. ..... 312/114; 312/126
(58) Field of Search ..... 312/114, 126, 312/127, 193; 108/152, 153; 211/72, 128.1, 134, 135, 153; 206/425, 558, 561, 562

(56) References Cited

U.S. PATENT DOCUMENTS

| | | | | |
|---|---|---|---|---|
| 1,012,959 A | | 12/1911 | Zaharis | |
| 1,013,032 A | | 12/1911 | Lund | |
| 1,106,543 A | * | 8/1914 | Burnham et al. | 312/126 X |
| 1,587,935 A | * | 6/1926 | Brunhoff | 312/126 X |
| 1,615,323 A | | 1/1927 | Brown | |
| 1,672,633 A | * | 6/1928 | Vogel | 312/126 X |
| 1,713,664 A | | 5/1929 | Kress | |
| 1,951,695 A | | 3/1934 | Harter | |
| 2,560,161 A | * | 7/1951 | Fay et al. | 211/72 |
| 2,665,808 A | * | 1/1954 | McAlister | 206/425 |
| 2,789,700 A | | 4/1957 | King et al. | |
| 3,186,558 A | | 6/1965 | Horstmann | |
| 3,496,889 A | * | 2/1970 | Protzmann et al. | 108/152 |
| 3,661,271 A | | 5/1972 | Fisher et al. | |
| 3,919,950 A | | 11/1975 | Frazelle et al. | |
| 4,160,570 A | | 7/1979 | Bridges | |
| 4,164,309 A | * | 8/1979 | Staats | 312/193 X |
| D257,993 S | | 1/1981 | DeMars | |
| 4,285,558 A | * | 8/1981 | Medford | 312/126 X |
| 4,304,354 A | * | 12/1981 | Shermer | 312/330.1 X |
| 4,684,019 A | * | 8/1987 | Egly | 206/425 X |
| 4,776,463 A | * | 10/1988 | Press | 206/425 X |
| 4,798,425 A | * | 1/1989 | Armstrong et al. | 312/321.5 |
| 4,817,900 A | | 4/1989 | Whittington et al. | |
| 4,836,622 A | | 6/1989 | Ferguson | |
| 5,560,500 A | | 10/1996 | Wilcox | |
| 5,806,692 A | | 9/1998 | Pepper | |

FOREIGN PATENT DOCUMENTS

| | | | |
|---|---|---|---|
| DE | 3119207 | * 12/1982 | 211/153 |

* cited by examiner

*Primary Examiner*—James O. Hansen
(74) *Attorney, Agent, or Firm*—Harness, Dickey & Pierce, P.L.C.

(57) ABSTRACT

A display case includes a shelf, a bracket and a clear cover. The shelf has at least one riser and at least one tread integrally formed together. The shelf is shaped to compliment at least one tread. The clear cover has an upper end and a lower end. The upper end may be coupled to the riser and the lower end may be coupled to the tread.

24 Claims, 8 Drawing Sheets

DISPLAY CASE

BACKGROUND AND SUMMARY OF THE INVENTION

The present invention generally relates to shelving units and, more particularly, to a light weight display case.

Many children and adults alike enjoy collecting various items and displaying them for others to see. Collectibles such as miniature automobile models and ceramic figurines typically include a high level of intricacy and detail. In addition, the collectibles are often times fragile. Accordingly, since repetitive cleaning of a collectible item would most likely lead to damage, it is desirable to cover or shield the item from dust. However, it is also desirable to view the collectibles while covered. Additionally, easy access to each display item is required to allow rearrangement of the display.

A variety of home furnishings have been designed in an attempt to meet a collector's storage and display needs. One example of such a home furnishing is a curio cabinet. A curio cabinet is typically constructed from wood and glass having legs to support the cabinet on a floor. While such a design may be useful in some applications, curio cabinets are typically very heavy, costly and cumbersome to transport. Other products, such as shelving units, also include certain drawbacks. Specifically, most shelving units do not provide an environment free from dust. Additionally, shelving units typically do not provide for a clear view of objects placed behind other objects on the same shelf.

Accordingly, it is desirable to provide a light weight, low cost and easily assembled display case mountable to a wall.

It is also desirable to provide a display case having a removable transparent cover to allow access to the displayed collectibles for rearrangement as desired.

The present invention includes a display case having a shelf, a bracket and a clear cover. The shelf has at least one riser and at least one tread integrally formed together. The top riser has a bifurcated upper edge defining a slot. The bottom tread has a lip extending upwardly therefrom. The bracket has a wall mounting portion and a shelf support portion. The shelf support portion is shaped to compliment at least one tread. The clear cover has an upper end and a lower end. The upper end is disposable within the slot. The lower end selectively engages the lip of the lower tread.

Further objects, features and advantages of the invention will become apparent from a consideration of the following description and the appended claims when taken in connection with the accompanying drawings.

DETAILED DESCRIPTION OF THE PREFERRED EMBODIMENT

Figure 1:
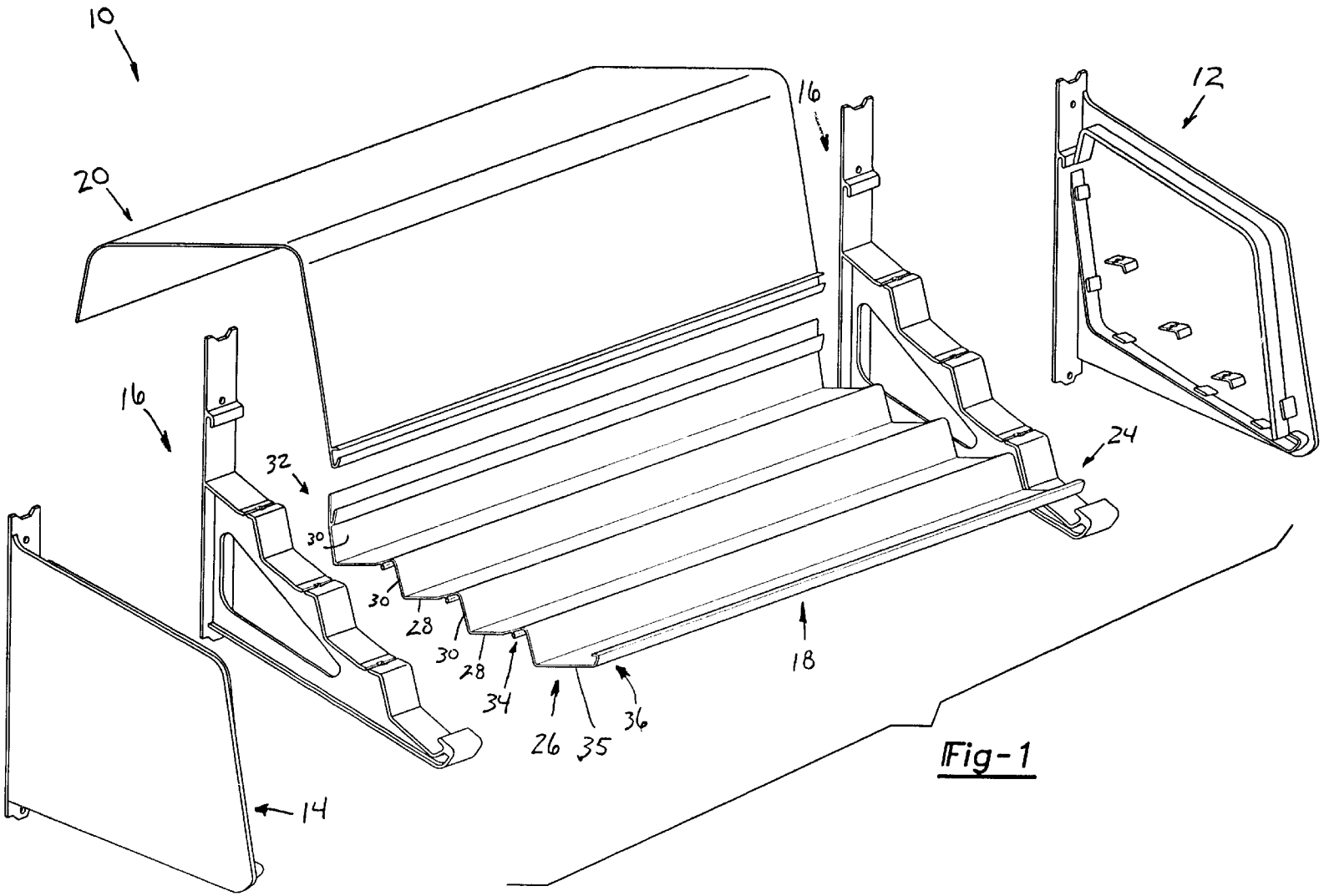
FIG. 1 is an exploded perspective view of a display case constructed in accordance with the teachings of the present invention.

With reference to FIG. 1, a display case constructed in accordance with the teachings of the present invention is generally identified at reference numeral 10. The display case 10 includes a first end cap 12, a second end cap 14, a pair of shelf brackets 16, a shelf 18 and a cover 20. First end cap 12, second end cap 14 and shelf brackets 16 are each separately mountable to a wall to support shelf 18 and cover 20. As will be described in greater detail hereinafter, first end cap 12 and second end cap 14 each include multiple protrusions to support and align shelf 18 and cover 20.

Shelf brackets 16 are shaped to compliment the stepped profile of shelf 18. Specifically, shelf 18 includes a first end 24, a second end 26, and a series of treads 28 and risers 30 extending between first end 24 and second end 26. Preferably, brackets 16 are equally spaced apart across the width of shelf 18 to provide support for collectibles placed thereon.

Display case 10 includes three retention devices to interconnect shelf bracket 16 and shelf 18. A first retention device 32 operates by interconnecting the upper most riser 30 and shelf bracket 16 to position shelf 18 relative to the wall. A second retention device 34 couples each of treads 28 except a lowermost tread 35 to each shelf bracket 16. Finally, a third retention device 36 supports, aligns and couples lowermost tread 35 to each shelf bracket 16.

It should be appreciated that the preferred embodiment of display case 10 with removable cover 20 is complete using only the components shown in FIG. 1. Additional hinges or other coupling components are not required to complete display case 10. Preferably, each of the components previously introduced are constructed from injection molded polyvinyl chloride or extruded polyvinyl chloride.

Figure 2:
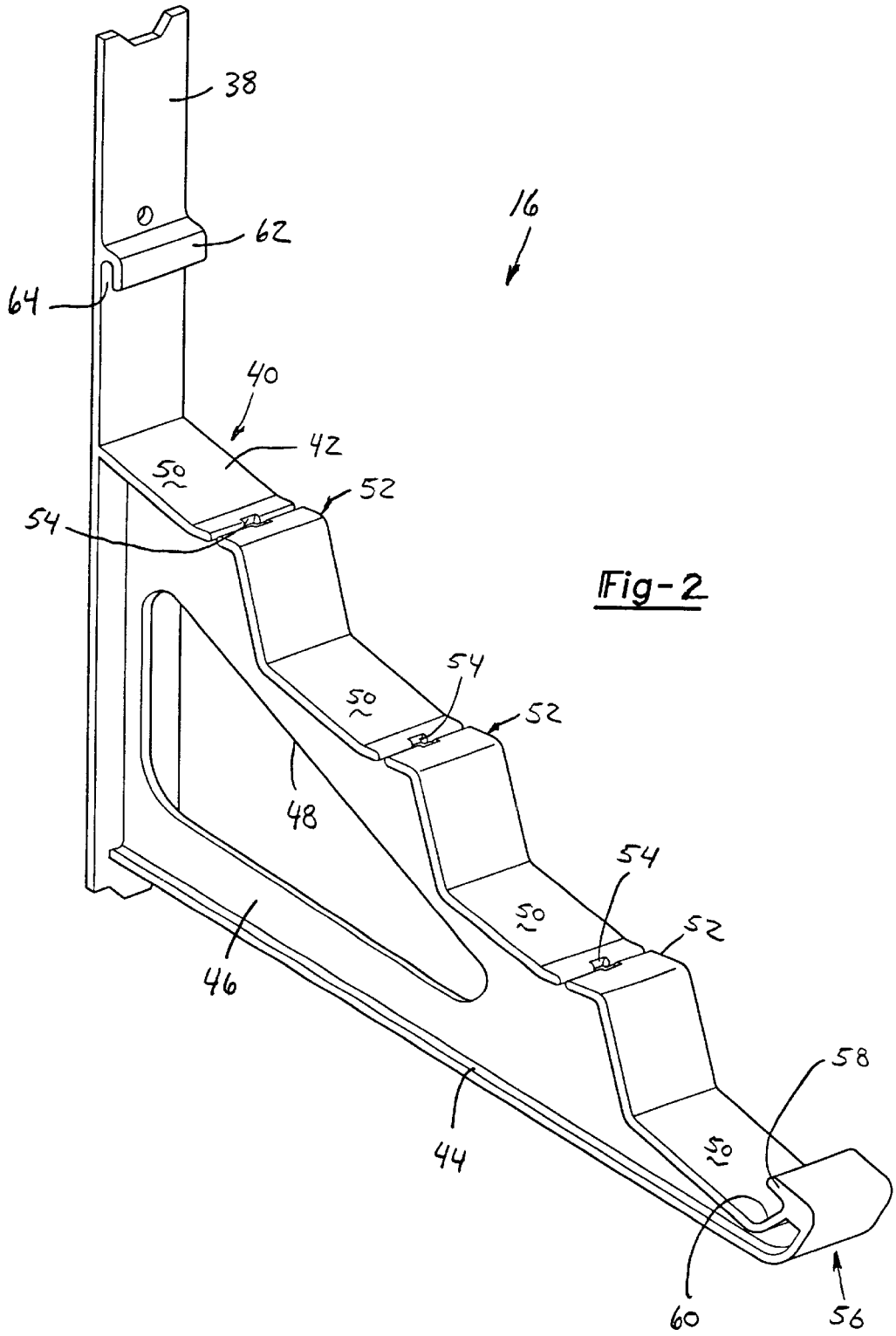
FIG. 2 is a perspective view of a stepped shelf bracket of the preferred display case.
Figure 3:
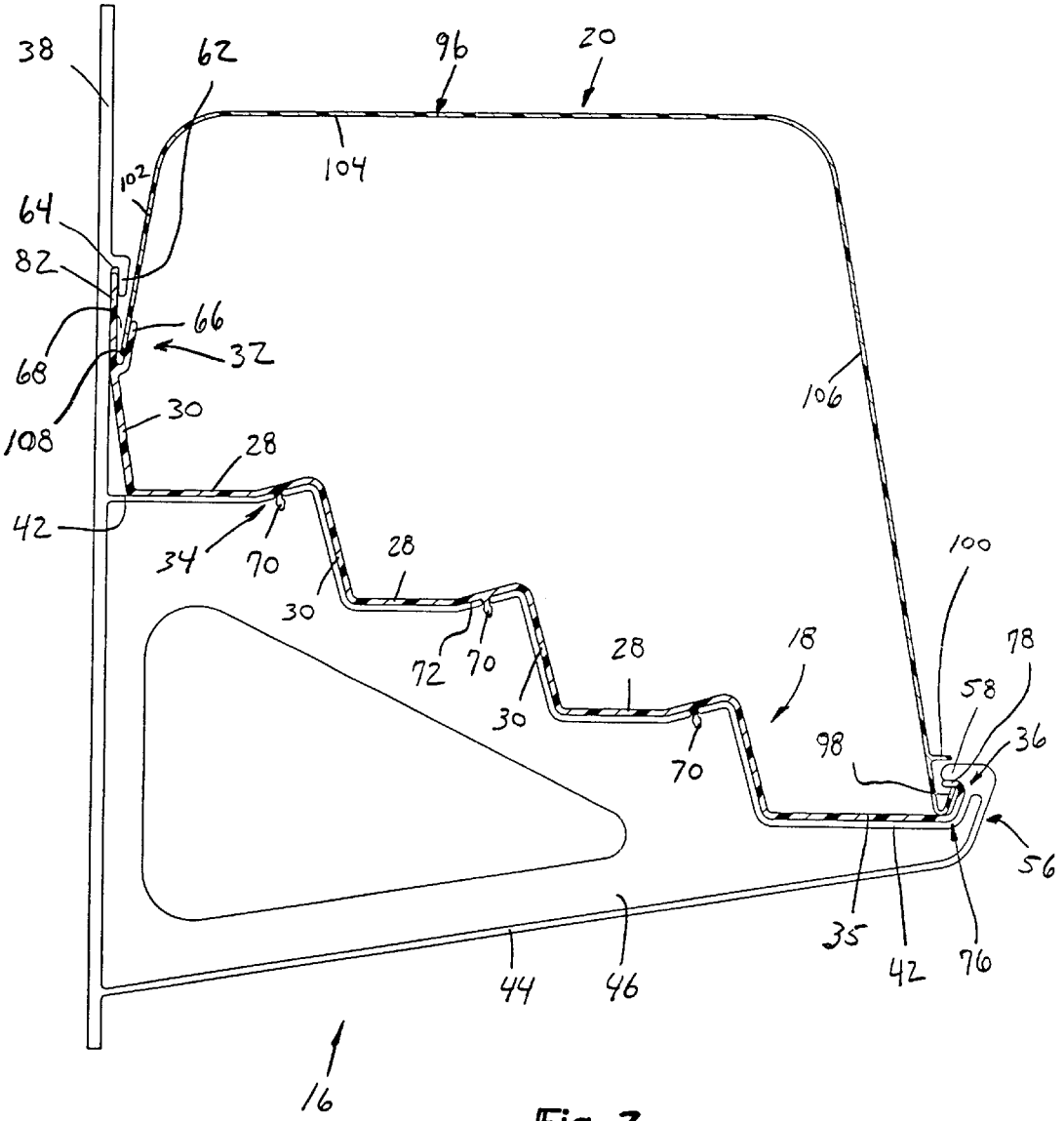
FIG. 3 is a cross-sectional side view of an embodiment of a display case assembly having a four level shelf.

As best shown in FIGS. 2 and 3, shelf bracket 16 includes a mounting flange 38 integrally formed with an orthogonally extending support 40. Support 40 is generally triangular in shaped having an I-beam type cross-section. A top 42 and a bottom 44 are interconnected by a web 46 to form the I-beam section. Web 46 includes an aperture 48 included to reduce the weight of shelf bracket 16. Top 42 is shaped to define four stepped support regions 50 corresponding to the dimensions of risers 30 and treads 28. The three upper most support regions 50 include a back angled portion 52 each defining a receptacle 54. Top 42 and bottom 44 intersect at a distal end 56 of support 40. At distal end 56, a finger 58 extends rearwardly toward mounting flange 38. Finger 58 cooperates with top 42 to define a bight 60. Shelf bracket 16 also includes a down turned hook 62 integrally formed with mounting flange 38. Hook 62 is spaced apart from mounting flange 38 to define a pocket 64.

Figure 4:
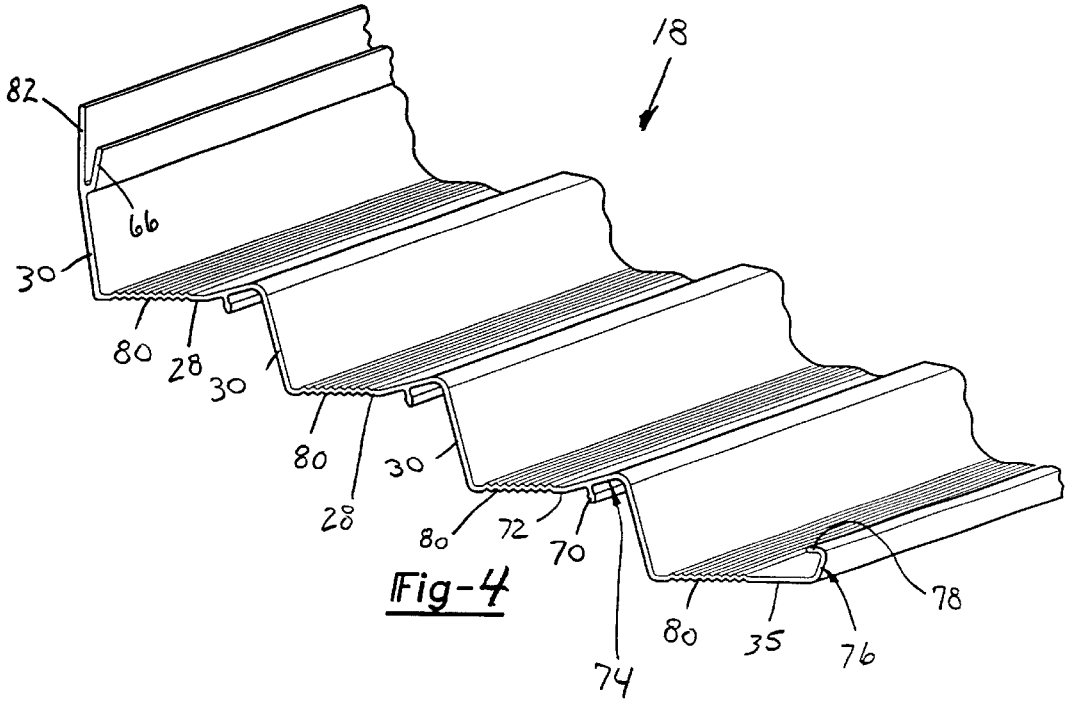
FIG. 4 is a perspective view of a four level shelf of the preferred display case.
Figure 5:
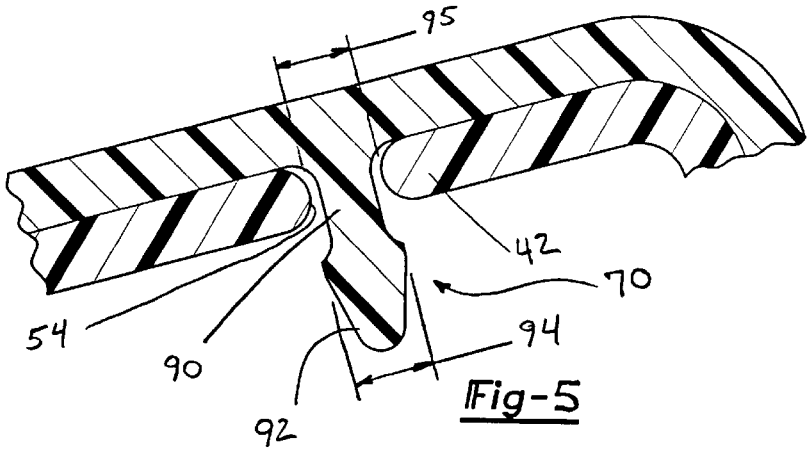
FIG. 5 is a magnified view showing a shelf-to-bracket attachment of the preferred display case.

With reference to FIGS. 3 ,4 and 5, shelf 18 includes a hinge tab 66 divergently extending from top riser 30 to define a trough 68 along the entire length of shelf 18. Shelf 18 also includes a set of barbs 70 extending from a bottom surface 72 of treads 28. Three back-angled portions 74 correspond to back-angled portions 52 of shelf bracket 16. Barbs 70 protrude from bottom surface 72 at each of back-angled portions 74. The bottom most tread 35 includes a generally open "J" shaped channel 76 having a lip 78 positioned at the distal end thereof. Shelf 18 includes four corrugated sections 80 positioned within each tread 28.

It should be appreciated that FIG. 3 depicts a partial subassembly of display case 10 including one shelf bracket 16, shelf 18 and cover 20. As noted earlier, display case 10 includes three retention devices to couple shelf 18 to shelf bracket 16. First retention device 32 functions by disposing an upper portion 82 of top riser 30 within pocket 64. Upper portion 82 is retained in place by hook 62.

In addition, and as more clearly depicted in FIG. 5, second retention device 34 incorporates barbs 70 to couple shelf 18 to shelf bracket 16 in a snap-fit arrangement. Each of barbs 70 includes a stem 90 and an integrally formed tapered portion 92 protruding from treads 28. Tapered portion 92 defines a maximum thickness 94 greater than a width 95 defined by receptacle 54 of shelf bracket 16. To couple shelf 18 to shelf bracket 16, the user must apply force to biasedly engage tapered portion 92 with top 42 until barb 70 is disposed within receptacle 54.

Third retention device 36 includes channel 76 of shelf 18 disposed within bight 60 of shelf 18. Finger 58 and top 42 encompass channel 76 to assure shelf 18 maintains a desired shape.

Cover 20 includes a body 96, a catch 98 and a tab 100. Body 96 is a generally C-shaped channel having a rear panel 102, a top panel 104 and a forward panel 106. Cover 20 is preferably constructed from a clear, colorless material moldable by extrusion. Each of the rear panel, top panel and forward panels are extruded at substantially the same thickness. Rear panel 102 includes a lateral edge 108 disposed within trough 68 to position cover 20 relative to shelf 18. As noted earlier, forward panel 106 terminates at catch 98. Catch 98 may be selectively engaged with lip 78 of shelf 18 to secure cover 20. When access to display case 10 is desired, the user simply pushes tab 100 to disengage catch 98 from lip 78 to allow removal of cover 20.

Figure 6:
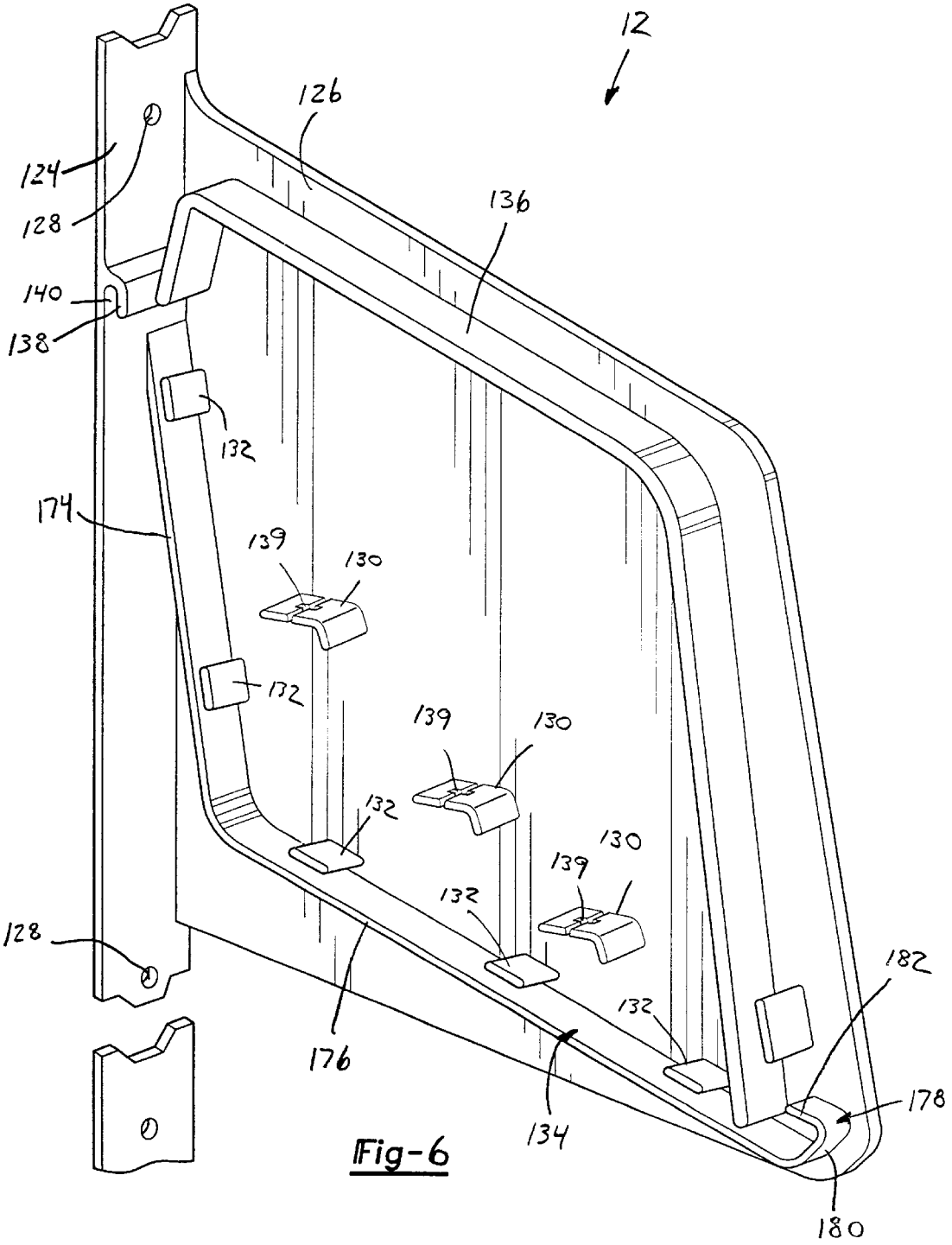
FIG. 6 is a perspective view of an end cap of the preferred display case.

With reference to FIG. 6, first end cap 12 includes a generally planar mounting flange 124 orthogonally intersecting a side wall 126. Mounting flange 124 includes a pair of fastener apertures 128 for receipt of fasteners (not shown). First end cap 12 further includes a first set of pegs 130, a second set of pegs 132, a lower rail 134, an upper rail 136 and a hook 138 orthogonally extending from sidewall 126. First pegs 130 are positioned along sidewall 126 to provide support for first end cap 12 of shelf 18. First pegs 130 each include a receptacle 139 for receipt of barbs 70 in a similar manner to that described earlier. Upper rail 136 provides edge support for cover 20. Hook 138 extends from sidewall 126 and from mounting flange 124 to define a pocket 140. As described with reference to bracket 16, upper portion 82 of shelf 18 engages hook 138. Second set of pegs 132 and lower rail 134 cooperate to retain portions of an alternate embodiment shelf discussed in greater detail hereinafter. Second end cap 14 is substantially the mirror image of first end cap 12. Accordingly, only first end cap 12 will be described in detail.

Figure 7:
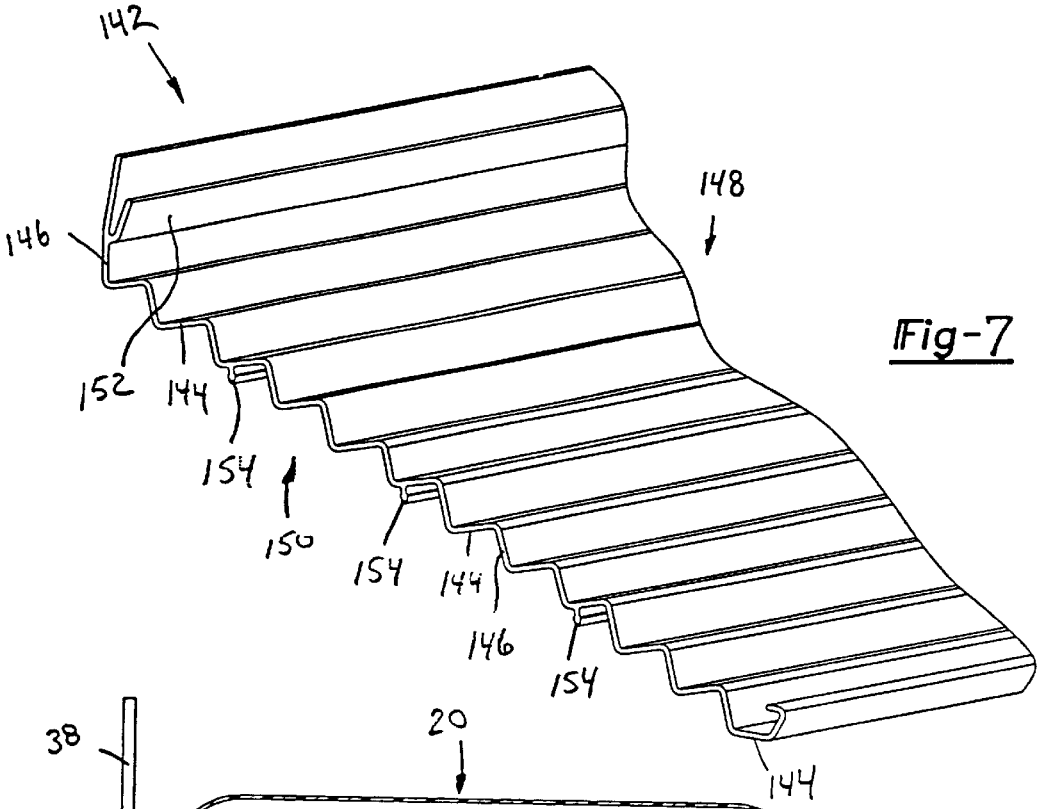
FIG. 7 is a perspective view of a sloped, multi-step shelf of the preferred displayed case.
Figure 8:
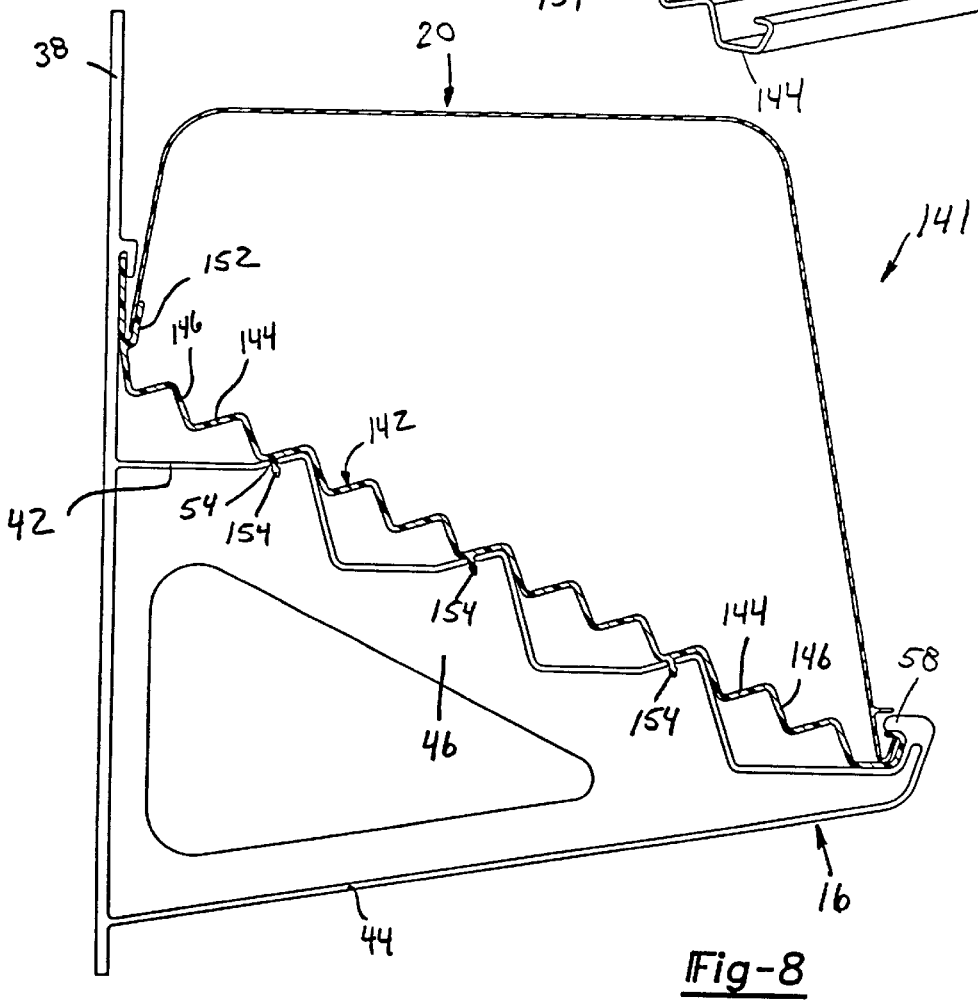
FIG. 8 is a cross-sectional side view of a display case assembly with a sloped, multi-step shelf.

Referring to FIGS. 7 and 8, a second embodiment of the display case of the present invention is generally identified at reference numeral 141. It should be appreciated that second embodiment 141 includes the same components as first embodiment 10 with the exception of replacing shelf 18 with a multi-step, sloped shelf 142. Accordingly, common elements will be identified with like numerals.

Shelf 142 includes twelve steps, each having a tread 144 and a riser 146 positioned between a first end 148 and a second end 150. The upper most riser 146 includes a diverging hinge tab 152 shaped identically to hinge tab 66 of shelf 18. Similarly, lowermost tread 144 functions substantially identically to lowermost tread 35 of shelf 18. Accordingly, the structure and function of these portions of shelf 142 will not be discussed in further detail.

Sloped shelf 142 further includes three barbs 154 downwardly extending from treads 144. However, barbs 154 are spaced apart every third tread to correspond with the locations of receptacles 54 within shelf bracket 16. As mentioned with respect to shelf 18, a user may couple shelf 142 to shelf bracket 16 by biasedly deforming barbs 154 into engagement with top 42 at receptacle 54.

Figure 9:
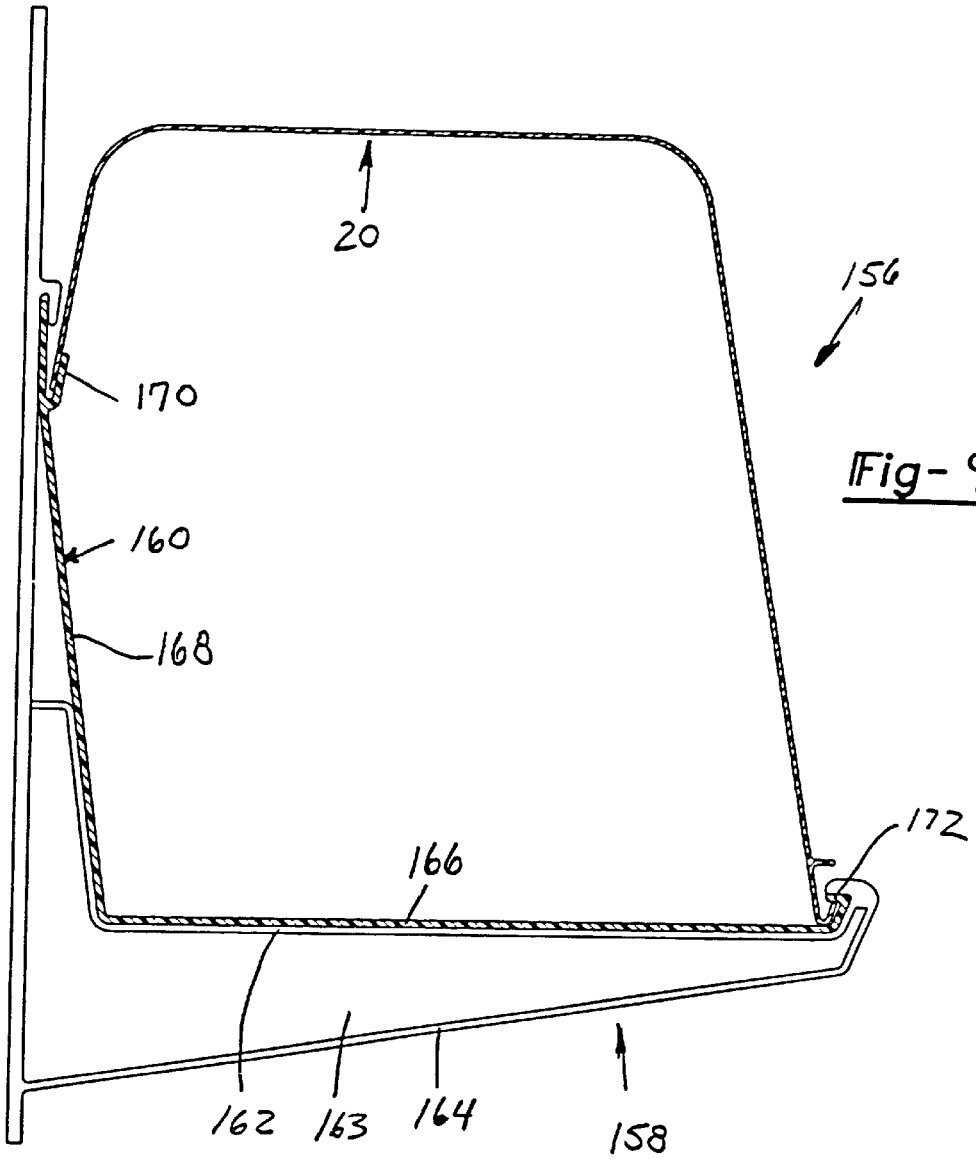
FIG. 9 is a cross-sectional side view of a display case assembly with a flat shelf.
Figure 10:
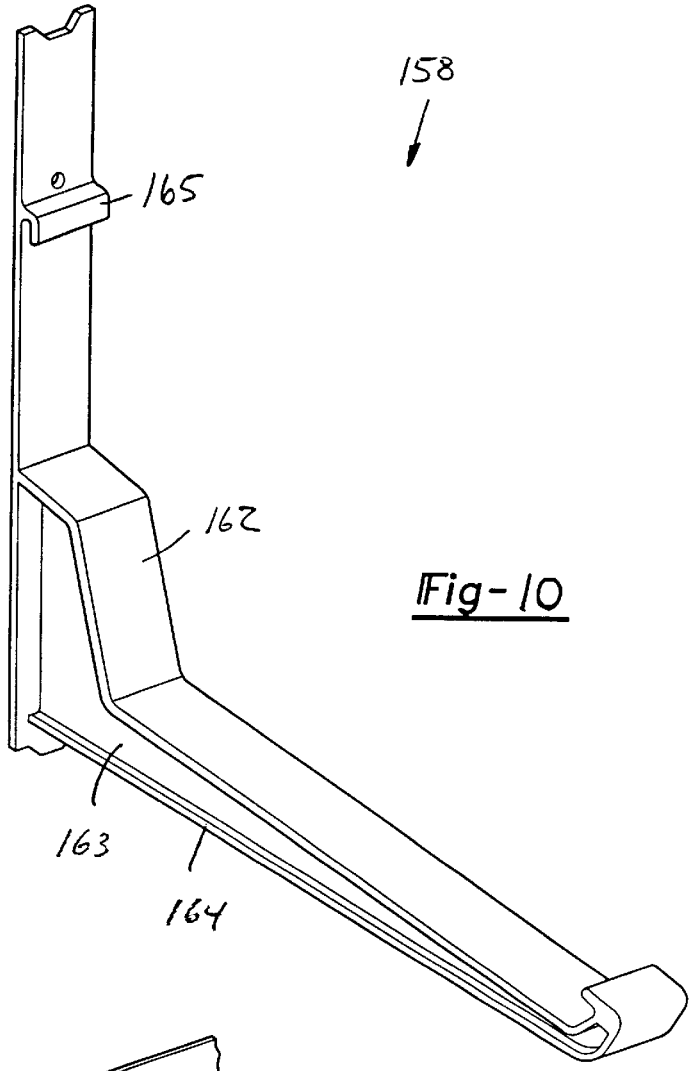
FIG. 10 is a perspective view of a flat shelf bracket of the preferred display case.
Figure 11:
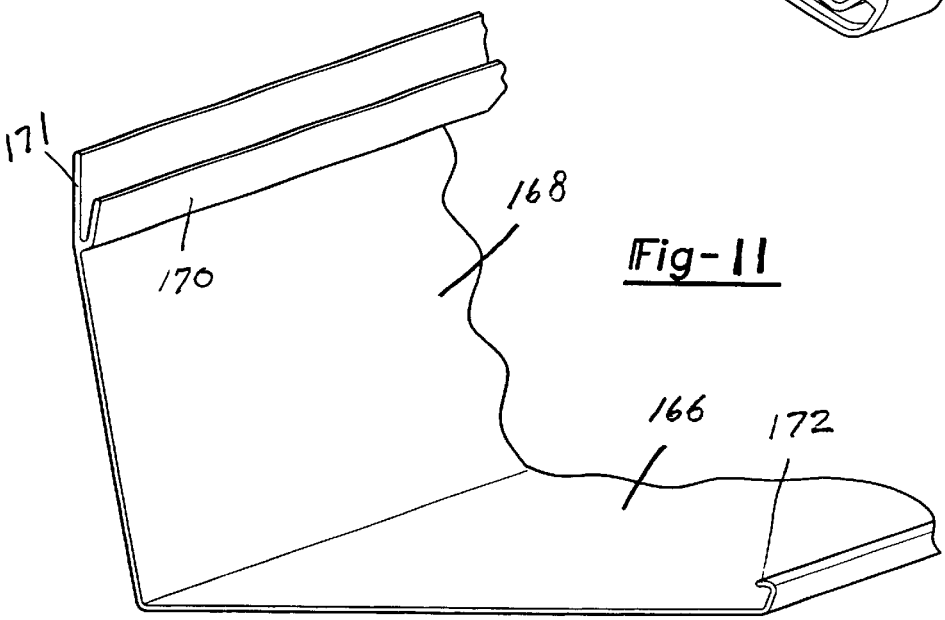
FIG. 11 is a perspective view of a flat shelf of the preferred displayed case.

With reference to FIGS. 9, 10 and 11, a third embodiment of the present invention is generally identified at reference numeral 156. Third embodiment 156 utilizes the common components of cover 20, first end cap 12 and second end cap 14. A flat shelf bracket 158 and a flat shelf 160 complete third embodiment 156. Flat shelf bracket 158 is generally "L" shaped including a top 162, a web 163, a bottom 164 and a hook 165. Flat shelf 160 includes one tread 166 and one riser 168. Riser 168 has a diverging hinge tab 170 substantially similar to hinge tab 66 of shelf 18. In addition, riser 168 includes an upper portion 171 to engage a hook 165. Tread 166 includes a lip 172 which is shaped identically to lip 78 of shelf 18.

With reference to FIG. 6, lower rail 134 of first end cap 12 includes a back portion 174, a bottom portion 176 and a latch portion 178. Latch portion 178 includes an end wall 180 and a finger 182. Back portion 174 and bottom portion 176 provide support for flat shelf 160. It should also be noted that flat shelf 160 is disposed between second set of pegs 132 and lower rail 134 to maintain the desired shape of the flat shelf. The interconnection between upper portion 171 and hook 62 along with the interconnection between tread 166 and finger 182 are accomplished in the same manner as previously described.

Therefore, it should be appreciated that the configuration and operation of the display case provides manufacturing and operational advantages over the prior art. Specifically, display case 10 of the present invention provides a light weight, low cost display case suited for mounting on a wall. Additionally, the provision snap-fit and interlocking components allows easy assembly resulting in a structurally robust display case.

The foregoing discussion discloses and describes merely exemplary embodiments of the present invention. One skilled in the art will readily recognize from such discussion, and from the accompanying drawings and claims, that various changes, modifications and variations may be made therein without departing from the spirit and scope of the invention as defined in the following claims.

What is claimed is:

1. A display case for mounting on a wall, comprising:

a shell having at least one riser and at least one tread integrally formed together and having substantially the same thickness, said shelf terminating at a top and a bottom, said top having a bifurcated upper edge defining a slot, said bottom having a lip extending upwardly therefrom;

a bracket having a wall mounting portion and a shelf support portion, said shelf support portion engaging said at least one tread; and a clear cover having an upper end and a lower end, said upper end disposable within said slot, said lower end selectively engaging said lip of said bottom.

2. The display case of claim 1 wherein said shelf includes a first retention device coupling said top to said bracket.

3. The display case of claim 2 wherein said shelf includes a second retention device coupling said at least one tread to said bracket.

4. The display case of claim 3 wherein said second retention device includes a barb extending from said at least one tread engaging said bracket.

5. The display case of claim 4 wherein said bracket includes a receptacle, said barb disposed within said receptacle, said barb in snap-fit engagement with said bracket.

6. The display case of claim 3 wherein said shelf includes a third retention device coupling said at least one tread to said bracket.

7. The display case of claim 6 wherein said third retention device includes a finger formed at an end of said bracket, said lip of said shelf engaging said finger.

8. The display case of claim 2 wherein said first retention device includes a hook extending from said bracket, said bifurcated upper edge of said shelf engaging said hook.

9. The display case of claim 8 wherein said hook and said bracket define a pocket, said bifurcated upper edge positioned within said pocket.

10. The display case of claim 1 further including a first end cap and a second end cap, wherein said shelf includes a first end coupled to said first end cap and a second end coupled to said second end cap.

11. The display case of claim 10 wherein each of said first and second end caps include a peg to support said at least one tread.

12. The display case of claim 11 wherein said first end cap includes a top rail to support a portion of said cover.

13. The display case of claim 12 wherein said first end cap includes a lower rail to support said lower end of said cover.

14. The display case of claim 1 wherein said wall mounting portion includes an upper locator and a lower locator, said upper locator complementing the shape of said lower locator whereby a lower locator of a first bracket cooperates with an upper locator of a second bracket when said first bracket is positioned above said second bracket.

15. A display case kit comprising:

a cover;

a first shelf having a first number of treads and risers;

a second shelf having a second number of treads and risers, wherein said second number of treads and risers is different than said first number of treads and risers; and a first bracket having a shelf support portion, said shelf support portion supporting a shelf member, said shelf member selected from the group consisting of said first shelf and said second shelf, wherein said cover selectively engages said shelf member.

16. The display case kit of claim 15 further including a third shelf having a third number of treads and risers and a second bracket adapted to support said third shelf.

17. The display case kit of claim 16 further including an end cap adapted to support each of said first shelf, said second shelf and said third shelf individually.

18. The display case kit of claim 17 wherein said end cap includes a first set of pegs adapted to engage each of said first shelf and said second shelf.

19. The display case kit of claim 18 wherein said end cap includes a second set of pegs adapted to engage said third shelf.

20. The display case kit of claim 15 wherein said first shelf includes a retention device interconnecting said first shelf and said first bracket.

21. The display case kit of claim 15 wherein said second shelf includes a retention device interconnecting said second shelf and said first bracket.

22. A display case comprising:

a bracket including a flange and an outwardly extending support, said flange including a hook extending downwardly therefrom to define a pocket, said bracket further including a finger extending from said support to define a bight;

a shelf having an upper riser and a lower tread, a portion of said upper riser being positioned in said pocket and a portion of said lower tread being positioned in said bight thereby coupling said shelf to said bracket; and a cover extending substantially across said entire shelf, said cover selectively engaging said shelf.

23. The display case of claim 22 further including a first end cap and a second end cap, each of said first and second end caps engaging said upper riser and said lower tread.

24. The display case of claim 22 wherein said bracket includes a receptacle and said shelf includes a barb, said barb biasedly engaged with said bracket and positioned within said receptacle.

* * * * *

UNITED STATES PATENT AND TRADEMARK OFFICE

CERTIFICATE OF CORRECTION

PATENT NO. : 6,497,461 B1 
DATED : December 24, 2002
INVENTOR(S) : Campbell Harlan It is certified that error appears in the above-identified patent and that said Letters Patent is hereby corrected as shown below:

Column 4,
Line 59, "shell" should be -- shelf --.

Signed and Sealed this

Twenty-fifth Day of March, 2003

JAMES E. ROGAN
*Director of the United States Patent and Trademark Office*